United States Patent [19]

McGarrity

[11] 4,321,436

[45] Mar. 23, 1982

[54] ELECTRICAL CIRCUIT INTERRUPTORS

[75] Inventor: Richard V. McGarrity, Drexel Hill, Pa.

[73] Assignee: Federal Pacific Electric Company, Newark, N.J.

[21] Appl. No.: 137,232

[22] Filed: Apr. 4, 1980

[51] Int. Cl.[3] ..... H01H 31/00

[52] U.S. Cl. ..... 200/48 KB; 200/162; 200/15

[58] Field of Search ..... 200/48 KB, 162, 153 G, 200/271, 15

[56] References Cited

U.S. PATENT DOCUMENTS

| | | | |
|---|---|---|---|
| 1,337,105 | 4/1920 | Templeton | 200/48 KB |
| 1,997,082 | 4/1935 | Reynolds | 200/48 KB |
| 2,309,909 | 2/1943 | Koppitz et al. | 200/162 |
| 2,650,284 | 8/1953 | Volgovskoy | 200/162 |
| 2,743,338 | 4/1956 | Graybill | 200/164 |
| 2,765,380 | 10/1956 | Graybill | 200/162 |
| 3,097,275 | 7/1963 | Wiktor | 200/78 |

*Primary Examiner*—Willis Little

*Attorney, Agent, or Firm*—Ronald R. Stanley; Roy F. Hollander

[57] ABSTRACT

The disclosed circuit breaker includes a movable contact which enters the space between stationary contact jaws, the movable contact acting through a spring to bias a jaw-closing toggle toward erect condition, so that contacts on the contact jaws firmly grip the movable contact.

7 Claims, 9 Drawing Figures

ELECTRICAL CIRCUIT INTERRUPTORS

BACKGROUND

The present invention relates to circuit making and breaking devices, and particularly to their contact structures.

The present invention will be considered in connection with "circuit breakers" although it will become apparent that the novel features are widely applicable to other forms of circuit making and breaking devices. The term "circuit breaker" as used in the art signifies apparatus for making and breaking a circuit at any level of current up to its rated current and extending to overcurrents and into the short-circuit range. Circuit breakers having rated currents of several hundred to several thousand amperes may be used in circuits where short-circuit current may reach 75,000 amperes for example. Circuit breakers are required to interrupt short-circuits repeatedly, safely and non-destructively. They are also required to close safely and non-destructively where there is a pre-existing short circuit at the load side of the circuit breaker, resisting electro-dynamic forces that might damage or even weld the contacts if there were any hesitation about completing the contact-closing operation. After closing on a pre-existing short-circuit, the circuit breaker mechanism is of course activated promptly into its opening operation, for safely and effectively interrupting the flow of current.

Circuit breakers for use in the 480 volt and 600 volt class are of the so-called "air-break" class, where an arc that develops in the course of current interruption is quenched in air in an arc chute, without benefit of coils on magnetic cores to drive the arc away from the contacts and into the arc chute. Large circuit breakers almost always have so-called main contacts and arcing contacts. The closing operation involves initial engagement of the arcing contacts which momentarily carry the current of the circuit. The main contacts close immediately afterward and virtually all of the current is then diverted away from the arcing contacts. During a reverse operation for interrupting current flow, the main contacts part initially, transfering the current to the arcing contacts, and when these contacts part, an arc develops which expands into the arc chute where it is quenched. Arcing should not occur at the main contacts when they part and, consequently, the main contacts remain clean, and provide a low contact-resistance current path through the circuit breaker while it is closed. This is true even during the very short time when short-circuit current flows and until the main contacts part and cause transfer of the current to the arcing contacts.

Traditionally, circuit breakers designed for meeting these arduous conditions have utilized so-called "butt" main contacts and either butt or "knife-blade" arcing contacts. When butt contacts close, the high speed of the moving contact tends to cause contact "bounce", which in turn may cause slight contact-damaging arcs. Powerful closing-spring mechanisms are usually provided to minimize contact bounce.

So-called "knife-blade" contacts have been used in switches designed for heavy currents, but "knife-blade" contacts have rarely been used as the main contacts of circuit breakers. Some finite time is spent while a moving knife-blade contact parts from companion stationary contacts in a wiping-contact motion; and under these conditions, during opening operations, small but damaging high-current arcs may develop at times, with resulting arcing damage to the contact surfaces. Thereafter, when the arc-damaged contact surfaces are again in engagement, objectionably high contact resistance and excessive heating tend to develop at the contacts. Worse, still, is the possibility of knife-blade contacts becoming welded together. Butt contacts tend to act abruptly in parting operations, and minimize these problems.

Knife-blade contacts are commonly used in simple switches, which are not intended to open under short-circuit conditions. Knife-blade contacts provide broad contact areas and they tend to be self-polishing due to the wiping action in the opening and closing motions of the switch, representing a low-resistance cool-operating contact configuration. Low resistance depends in part on the contact pressure; and in order to achieve high-contact pressure, powerful switch-closing effort must be available. An adaptation of the knife switch is the so-called bolted-pressure switch. These are basically knife-blade switches wherein, during the final operation of the closing mechanism, the fixed and moving contacts are tightened against each other by a threaded or cammed clamping mechanism, activated by the arm that carries the moving contact or by its operating means. The clamping mechanism is activated near or at the fully-closed phase, so that the requisite closing effort is minimized even though high contact pressure is developed.

SUMMARY OF THE INVENTION

The illustrative embodiment of the invention shown in the accompanying drawings and described in detail below is a three-pole circuit breaker having moving main and arcing contacts operated in closing and opening motions by means of a stored-energy spring operating mechanism that effects high-speed closing and opening operations of the contacts. As is customary, the arcing contacts close before the main contacts as the circuit breaker closes, and the main contacts part before the arcing contacts. The main contacts are protected against occurrence of arcing, to have low-resistance cool-operating contacts while the circuit breaker is closed.

The main contacts provide a sustained low-contact-resistance current path while closed, so that only a limited temperature rise occurs. They comprise one or more pairs of jaws that are widely separated when the circuit breaker is open. As the moving contact member enters the space between contacts carried by the jaws, the moving contact member acts on jaw-closing means that operates rapidly, forcing the jaws grip the moving contact member tightly. To special advantage, the moving contact member drives a spring to erect (incompletely) a jaw-closing toggle. As the moving contact member completes its stroke, it wipes against the gripping contacts of the jaws. There is little if any tendency of contact-parting to occur as the moving contact member completes its closing motion so that the stored-energy operating mechanism does not need excess capacity for suppressing contact bounce.

Where a toggle or its equivalent is used for developing tight grip of the stationary contacts against the moving contact member, the contacts tend to maintain firm engagement and thus suppress arcing even if electrodynamic forces were to develop under short-circuit conditions tending to part the main contacts.

The above-mentioned toggle for closing the stationary contact jaws on the moving contact member, where the moving contact member acts through a spring in driving the toggle toward erect condition, has the further advantage of compensating for wear and erosion of the contacts. As some wear occurs, the spring causes the toggle to become more nearly erect.

The operation of the movable contact member in the opening direction is accompanied by relaxation of the bias of the toggle-erecting spring. Furthermore, another spring is advantageously included to induce the toggle to buckle, thereby parting the jaws from the movable contact member.

The foregoing summary includes certain details regarded as exemplary. However the nature of the invention and its further novel aspects and features will become more apparent and will be better appreciated from consideration of the illustrative embodiment that is shown in the accompanying drawings and described in detail below.

THE ILLUSTRATIVE EMBODIMENT

Figure 1:
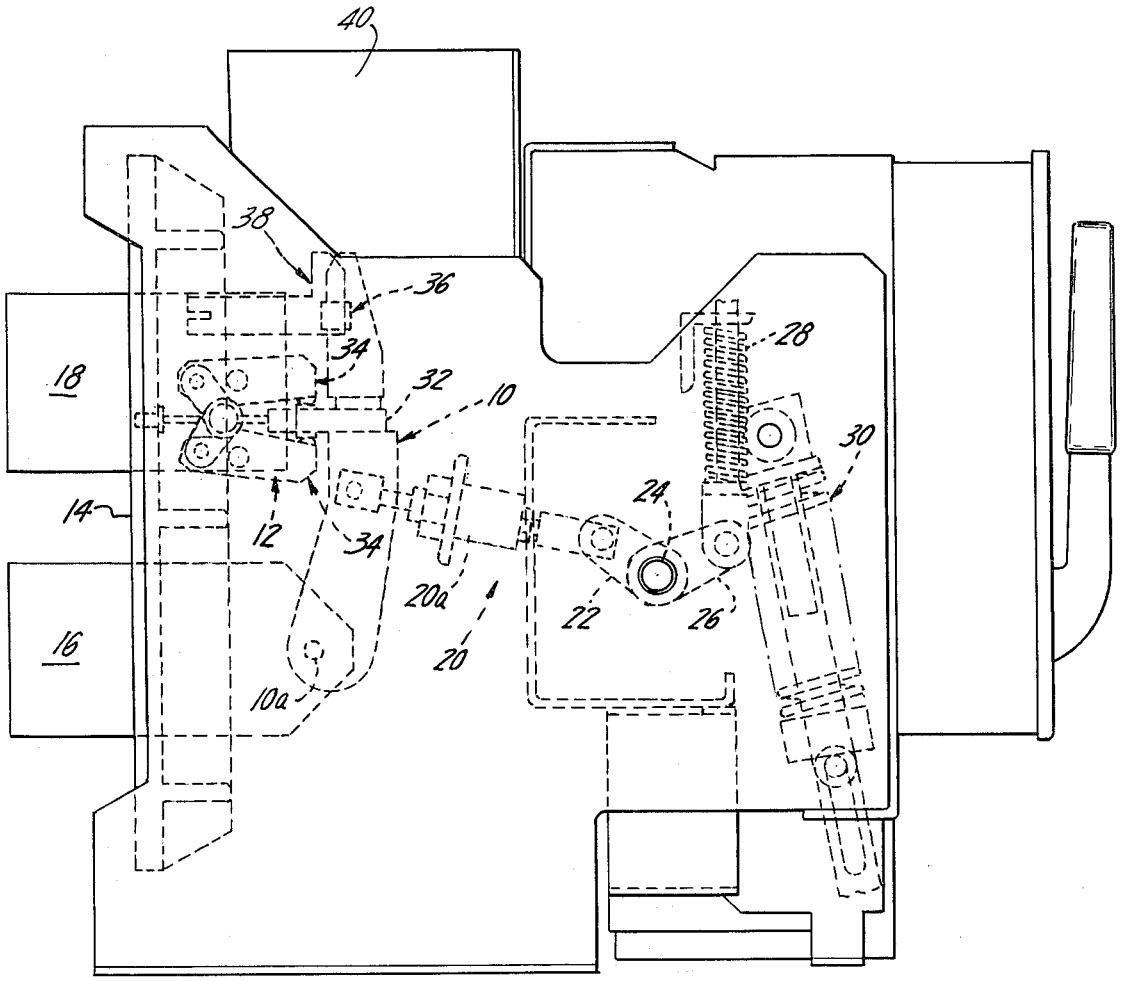
FIG. 1 is a lateral view of a circuit breaker embodying features of the invention.

Referring now to FIG. 1, a circuit breaker is shown incorporating novel features of the invention. The circuit breaker includes a moving contact arm 10 that cooperates with a stationary contact assembly 12 carried by blocks or plates 14 of insulation. Terminals 16 and 18 extend through each plate 14, bearing moving contact assembly 10 and stationary contact assemby 12, respectively. Moving contact assembly 10 is shown "closed", in cooperation with the stationary contact assembly, so that a circuit is made between terminals 16 and 18.

Figure 2:
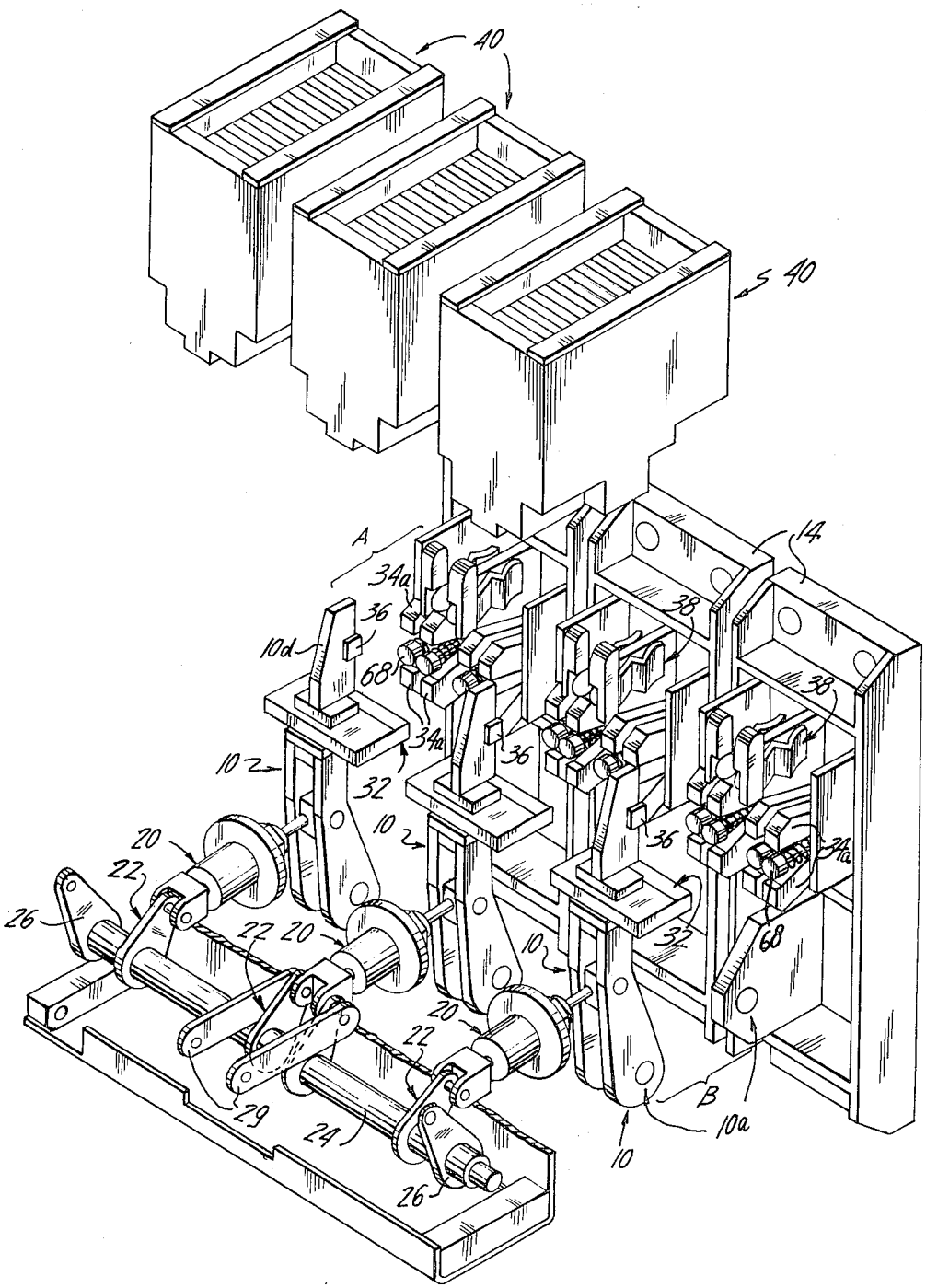
FIG. 2 is an exploded perspective view of internal portions of the circuit breaker in FIG. 1.

As seen in FIG. 2, the circuit breaker has three poles, including three contact arms 10 which are operated by links 20, pivoted to and operated by respective cranks 22 on operating shaft 24. Cranks 26 which are fixed to shaft 28 near the opposite ends of the shaft enable compression coil springs 28 to apply contact-opening bias to shaft 24 and, in turn, to the moving contact arms 10. Each link 20 incorporates an insulating member 20*a*.

A pair of links 29 (FIG. 2) couple cranks 22 of the center pole to a stored-energy spring operating mechanism for closing the contacts. In FIG. 1 the spring operating mechanism is symbolically represented by closing spring 30. Such spring operating mechanisms are well known and, for example, may take the form shown U.S. Pat. No. 3,097,275 issued July 9, 1963 to D. Wiktor. Energy is stored in the springs of this mechanism either by a motor or a hand-operated ratchet mechanism; and after the spring has been fully charged, it (or a linkage that restrains it) is selected for driving shaft 24 in the contact-closing direction abruptly and at high speed, providing a substantial amount of contact-closing force. In FIG. 2, the vertical contact arms 10 are shown in their "closed" position but, because the drawing is an exploded view, the drawing includes a space A between the moving contact end of arm 10 and the companion stationary contacts, and there is a space B in FIG. 2 between the two portions of pivot 10*a* at the lower end of each contact arm 10. Spaces A and B appear in FIG. 2 so that the elements are more recognizable than they would be were such spaces eliminated.

The stored-energy spring closing mechanism closes the breaker when a manual or remote-control latch is released, for a quick contact-closing motion of shaft 24. When cranks 22 become nearly aligned with links 20, contact arms 10 are in their "closed" positions. A current path may be traced through the circuit breaker from terminal 16, via contact arm 10, main contact member 32, main contact assembly 34, to terminal 18. A further current path can be traced from terminal 16 and contact arm 10 to moving arcing contact 36 companion stationary arcing contact 38, and terminal 18. These current paths (as viewed in FIG. 1) represent curves or loops basically including terminal 16, arm 10 and terminal 18. Under normal conditions, this current path in the form of a loop does not pose any important problem. However, both when a short circuit develops while the circuit breaker is closed as well as when the circuit breaker closes against a short circuit, a large amount of blow-off force develops in contact arm 10 due to the electrodynamic forces identified with such a current loop. The fact that cranks 22 and links 20 are nearly aligned when the closed condition of the circuit breaker is attained is a factor assisting the stored-energy spring mechanism in its contact-arm closing operation. However, when a short circuit exists or develops a release latch enables the contact arms to be opened, being driven by springs 28 and by the electrodynamic contact-opening forces of the current loop. Springs 28 are also effective for opening the contact arms when the current level is not high enough to develop significant blow-open force. The contact-opening release mechanism becomes effective in the event of an overload or a short-circuit, or when remote-release is required, and when the circuit breaker is opened by manual operation of a release latch.

The foregoing discussion of the closing and opening mechanisms and the electrodynamic forces encountered in the operation of the illustrative type of circuit breakers is intended to provide a perspective for appreciation of the operating conditions encountered by the contact mechanisms to be described hereinafter.

Circuit breakers of this type commonly include arc chutes 40, shown in FIG. 2 as being lifted away from their normal positions seen in FIG. 1. When a circuit breaker of this type opens, the current path from the moving contact member 32 to the companion stationary contacts 34 is interrupted initially so that the current through the circuit breakers transfers to the moving and fixed arcing contacts 36 and 38. When those contacts part during flow of light or heavy current, an arc develops which blows up into the arc chute where it is quenched.

Figure 6:
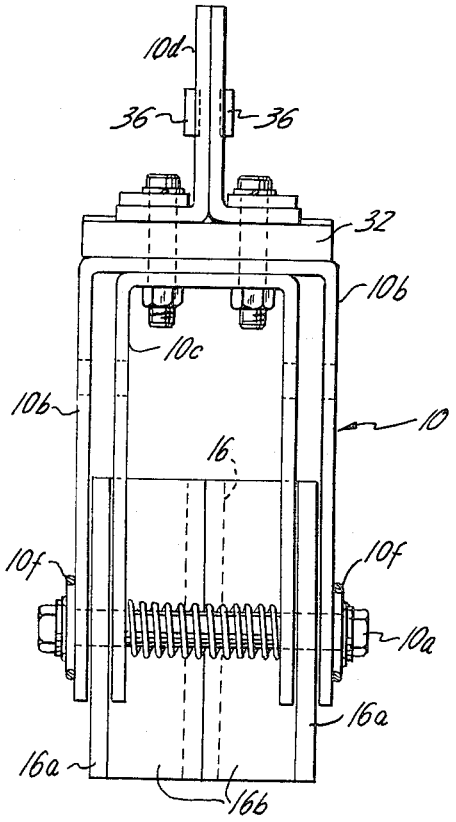
FIG. 6 is a vertical elevation of one of three moving contact arms in FIG. 2, as viewed from the lower left hand corner of FIG. 2.

As seen in FIG. 6, contact arm 10 has a pivot 10*a* that extends through two parallel plates 16*a* extending at right-angle bends from integral parts 16*b* of terminal 16. Arm 10 includes inverted-U-shaped bars 10*b* and 10*c* as of copper, carrying movable contact member 32. Contacts 36 are fixed to brackets 10*d* bolted to the main contact member 32. Compression coil spring 10*e* presses bars 10*c* against plates 16*a*, and conical springs 10*f* presses bar 10*b* against plates 16*a*.

Stationary contact mechanism 12 is shown in detail in FIGS. 3–5 and 7–9. Terminal 18 is formed of three plates of copper or other high-conductivity metal, including a flat center-plate 18*a* and two outer plates 18*b*. These three plates are united at the back of each insulating block 14. As seen in FIG. 2, one insulating block 14, is provided for each of the three poles. At the front of insulating block 14, plates 18*b* are bent flat against insulating block 14 and extend away from each other, and they extend forward from second bends, parallel to each other.

Figure 3:
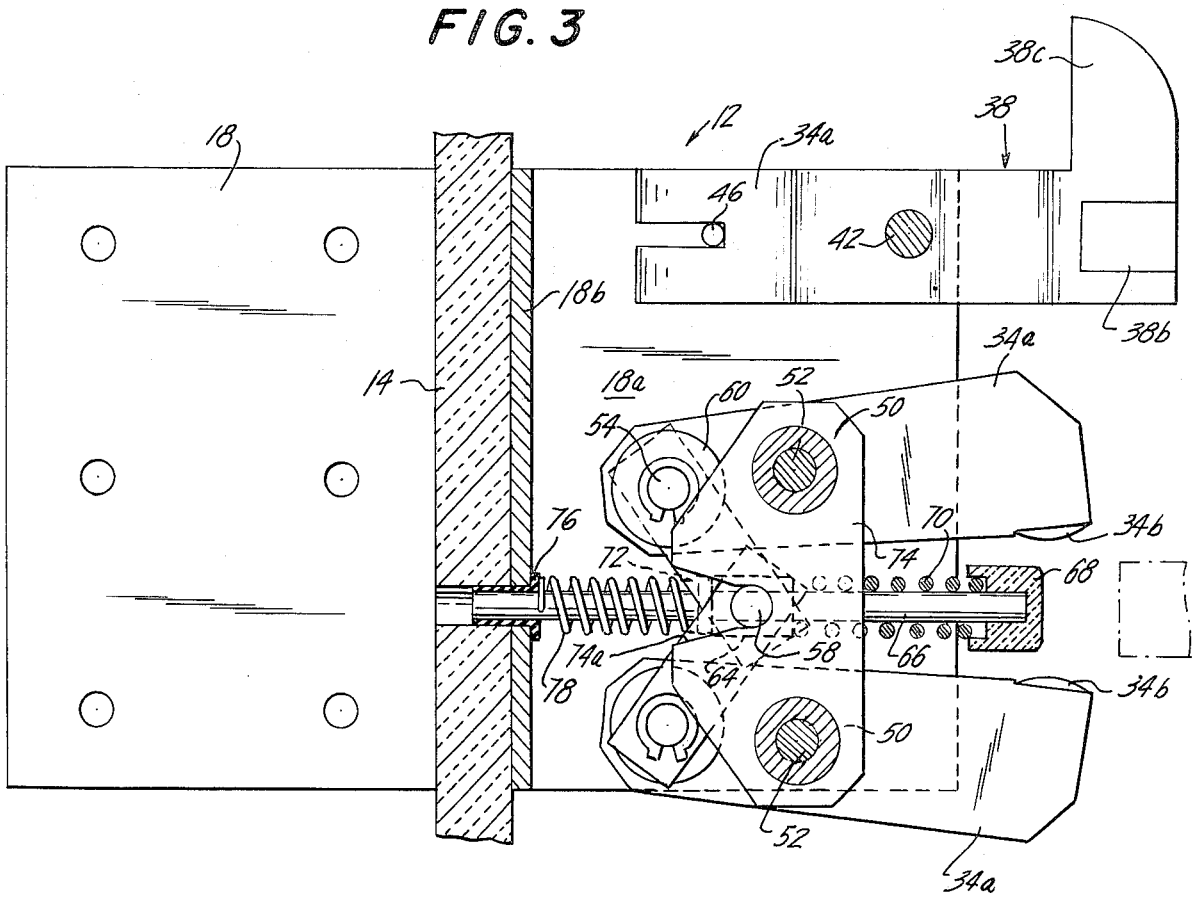
FIG. 3 is a lateral cross-section at the plane 3—3 in FIG. 4 of the stationary contact assembly of the circuit breaker in FIGS. 1 and 2.
Figure 4:
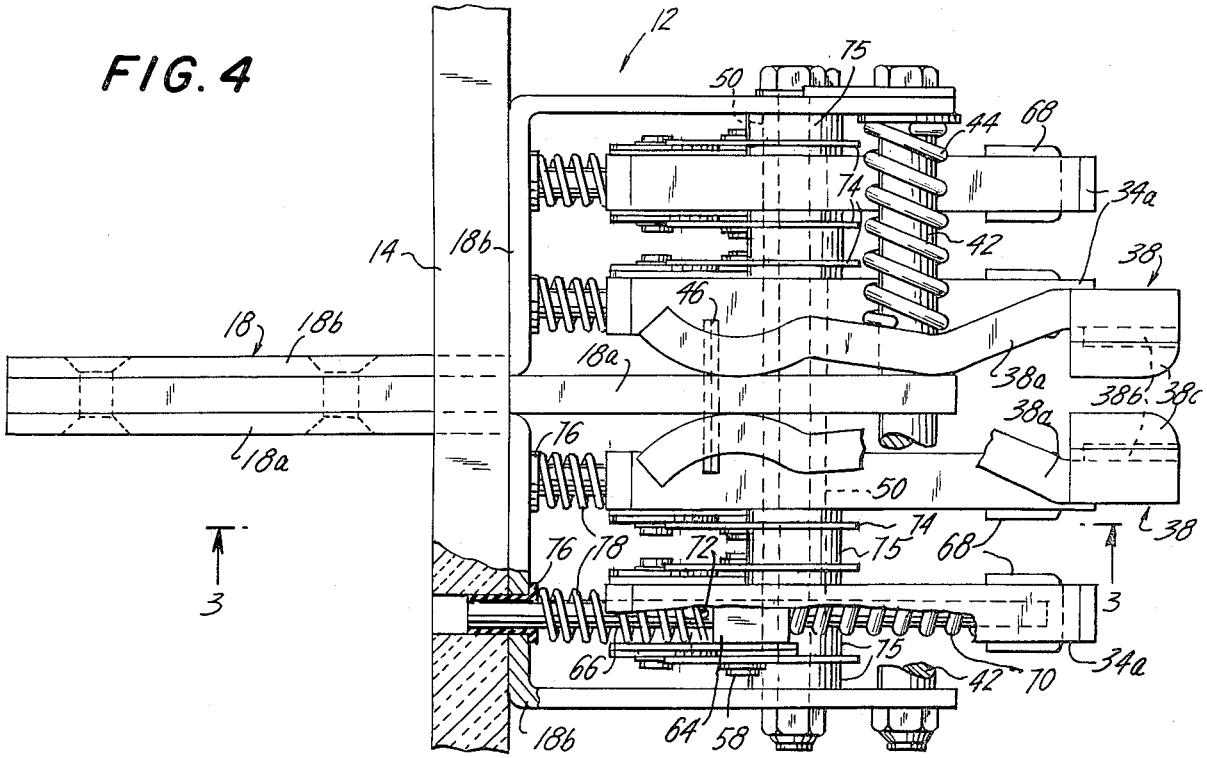
FIG. 4 is a top plan view, with portions broken away for clarity, of the stationary contact assembly of FIG. 3.

As best shown in FIGS. 3 and 4, stationary arcing contact members 38 for each of the three poles of the circuit breaker include a pair of bars 38*a* as of copper that carry refractory contact members 38*b* as of silver-tungsten. Arcing horns 38*c* extend upward from arcing contact members 38*b*. A bolt 42 extends through plate 18*a* and both plates 18*b* and carries a pair of compression coil springs 44 which bias bars 38*a* firmly against plate 18*a* when the circuit breaker is open. Bars 38*a* are slotted at the rear and receive a locating pin 46 which is fixed in plate 18*a*. When one contact arm 10 is driven into its closed position, arcing contacts 36 as of silver tungsten are forcibly driven between stationary arcing contacts 38, driving the contact-bearing ends of bars 38*a* farther apart than is shown in FIG. 4, against the bias of springs 42. Bars 38*a* remain firmly biased against blade 18*a* near pin 46. Bars 38 provide parallel current paths, so that they are pressed firmly against plate 18*a* and contacts 36 during moments of high currents, due to electrodynamic attraction.

The main "stationary" contact assembly which is companion to the moving main contact member 32 includes (for example) four pairs of rigid jaws or bars 34*a* (FIGS. 4 and 5) bearing contacts 34*b* that are normally of pure silver, to provide low contact-resistance when in engagement with moving contacts of silver on main moving contact member 32. Jaws 34*a* are pivoted between their ends on long tubes 50 of copper or other high-conductivity metal. A single bolt 52 extends in succession through one plate 18*b*, a first tube 50, plate 18*a*, a second tube 50, and the second plate 18*b*. Bolt 52 is tightened to provide a low-resistance current path from each jaw 34*a* to plates 18*a* and 18*b* that constitute terminal 18. One bolt 52 and two tubes 50 provide mechanical support for four upper contact jaws 34*a*, and (See FIGS. 3 and 5) another bolt 52 and two more tubes 50 provide mechanical support for four lower contact jaws 34*a*.

Figure 5:
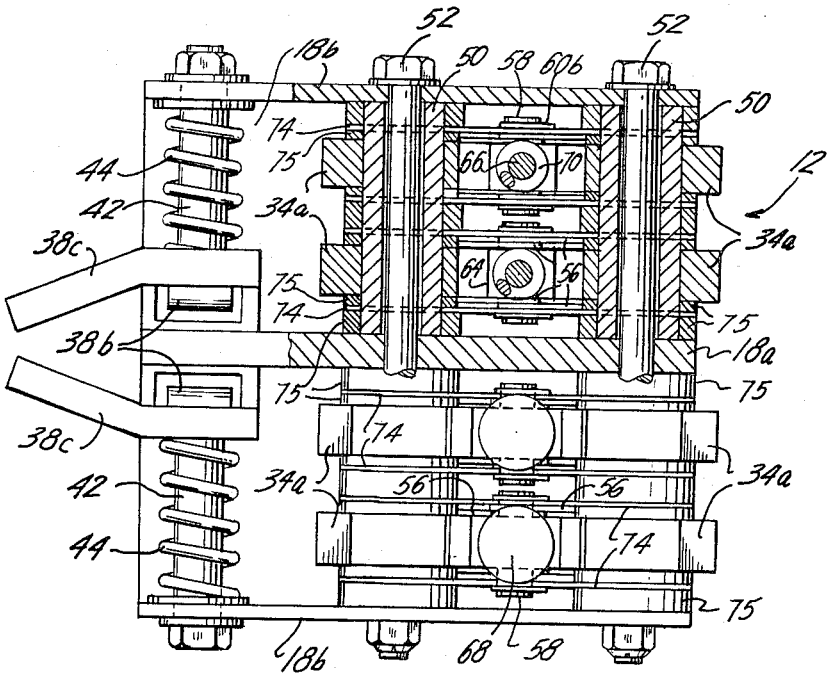
FIG. 5 shows the stationary contact assembly of FIGS. 3 and 4, partly in cross-section, as viewed from the right of FIG. 4.
Figure 8:
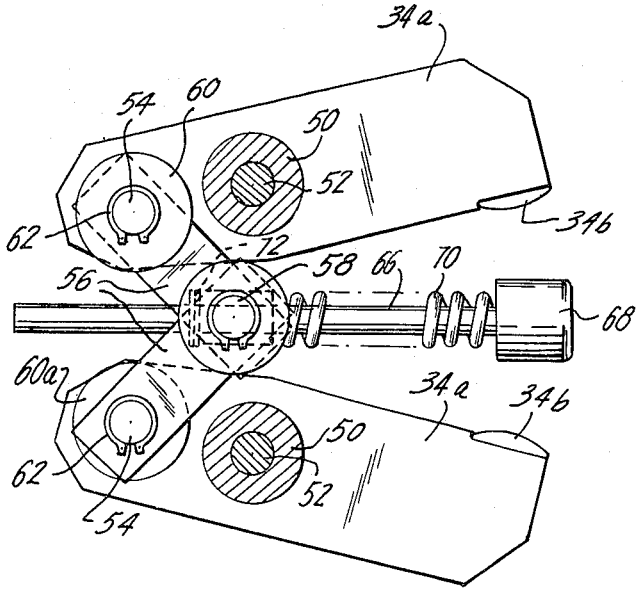
FIG. 8 is a view similar to FIG. 3 of certain components of the main stationary contacts.
Figure 9:
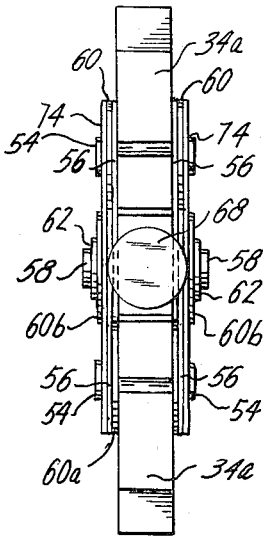
FIG. 9 is a view of a pair of main contact jaws and its operating parts viewed from the right of FIG. 3.

As seen in FIGS. 3, 8 and 9 there is a pivot pin 54 through the end of each jaw 34*a* remote from contact 34*b*. A pair of upper and lower toggle links 56 are pivoted on pins 54 at the remote ends of these links, and both toggle links 56 form a knee at pivot pin 58. As seen in FIGS. 4, 5 and 9 there is a pair of toggle links 56 at each side face of each pair of jaws 34*a*. A spacing washer 60 on pivot pin 54 overlies the upper toggle link 56; and a snap-ring 62 (received in a groove in pivot pin 54) holds washer 60 and link 56 against contact jaw 34*a*. The same construction is provided at both sides of the upper bar 34*a* (FIGS. 5 and 9). A spacing washer 60*a* is provided between a side face of contact bar or jaw 34*a* and the lower link 56 at a pivot pin 54. A snap ring 62 (received in a groove in pivot pin 54) retains lower link 56 and washer 60*a* against one side face of contact bar 34*a*. A like construction of spacing washer 60*a*, lower toggle link 56 and retainer 62 is found at the opposite side face of lower contact bar or jaw 34*a*.

A pair of pivot pins 58 at which the knee of the toggle is formed extend integrally from opposite sides of block 64. Rod 66 is slidably received in a bore in block 64. At the right-hand extremity of rod 66 as seen in FIG. 8, a head 68 of insulation is fixed to the rod. A compression coil spring 70 is confined between block 64 and head 68. Pin 72 extends through rod 66 and limits the extent to which block 64 can be moved away from head 68.

As seen in FIG. 3, a stationary plate 74 is supported on tubes 50, flanking the toggle knee, there being a one such plate 74 at each side of an upper and lower pair of jaws or contact bars 34*a*. Washers 75 on tubes 50 act to fix plates 74 at the proper places. A pair of toggle links 56 is disposed between each plate 74 and one side of each pair of jaws 34*a*. Pivot pin 58 extends through a slot 74*a* in plate 74. The edges of slot 74*a* diverge from right to left as viewed in FIG. 3. Rod 66 extends through a bushing 76 of insulation, for example, nylon, that is received in a bore through plate 18*b* and back-plate 14 of insulation. A compression coil spring 78 surrounding rod 66 is confined between pin 72 and insulating bushing 76. When the circuit breaker is open, spring 78 biases pin 72, block 64 and the pivot-pin extensions 58 of block 64 toward the right and into the right-hand extremity of slot 74*a*. Washer 60*b* on pivot pin 58 slides against the outside face of plate 74 and is held in place by a snap ring 62 which is received in a groove in pin 58. Plate 74 forms an outer guide for a respective pair of toggle links 56, and washer 60*b* assures stable retention of the toggle knee-pivots 58 in slot 74*a*.

Figure 7:
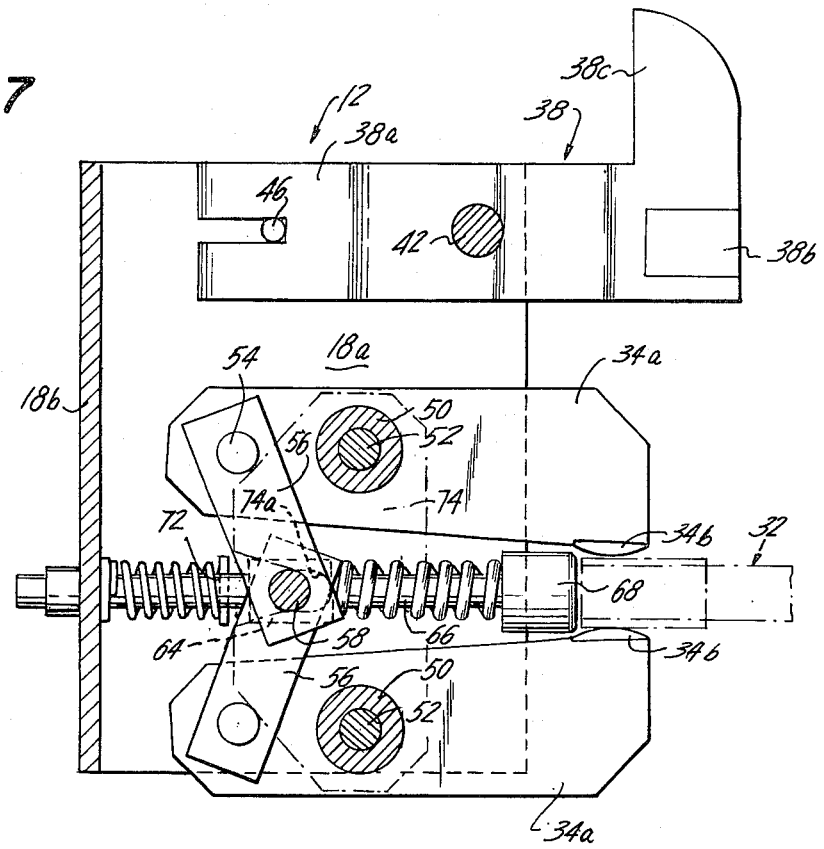
FIG. 7 is a view similar to FIG. 5 of the stationary contact assembly with the main contacts thereof "closed" and gripping the main moving contact which is shown in phantom, and including a toggle-guide-plate in phantom.

The parts illustrated in FIG. 3 represent the open condition of the stationary contact assembly 34. Moving contact member 32 moves from the left in FIG. 3 in the closing operation of the circuit breaker. Following engagement of member 32 against head 68 of insulation, further movement drives rod 66 to the left, carrying stop pin 72 with it. Spring 70 pushes block 64 with its pivots 58 to the left as pin 72 withdraws to the left. During this operation, both compression springs 70 and 78 become further compressed. Movement of rod 66 to the left displaces pin 72 and allows springs 70 (at opposite sides of each pair of jaws 34*a*) to bias block 64 to the left. Springs 70 thus apply bias to erect the toggles. As the toggles become progressively more erect, the contacts at the right hand extremities of contact bars 34*a* (as viewed in FIG. 3) close against silver contacts at the top and bottom surfaces of moving contact member 32. When the contacts 34*b* are pressed firmly against contact member 32, further erecting motion of the toggle links is prevented. Moving contact member 32 can and normally will continue its motion in the closing direction and thereby displace rod 66 further to the left. However when further erecting operation of the toggle links can no longer occur because closing motion of contacts 34*b* has been arrested. Rod 66 simply slides in block 64 and moves pin 72 away from block 64 (FIG. 7). During this final motion of contact member 32, the moving contacts on member 32 are in firm wiping contact with the contacts 34*b*. Such wiping motion of contacts while they are firmly in engagement is highly desirable in that such action tends to restore smoothness to the contact surfaces in case unusually pitting or balling of the contact material should develop in a previous contact-opening operation. Such wiping contact also has the effect of clearing away any surface contamination that might develop over a period of time, which otherwise would cause increased contact resistance. Low contact resistance is considerably enhanced by the heavy contact pressure attained as a result of the erecting toggles. Those toggles are all operated resiliently (rather than positively) by spring 70. As a result, firm contact pressure develops over many operations of the circuit breaker despite possible erosion of the contacts due to wear and to occasional slight arcing. Contact pressure of the main contacts 34*b* against moving contact member 32 is increased during moments of high short-circuit current because the bars 34*a* then carry current in the same direction along parallel paths so that jaws 34*a* are attracted toward each other electrodynamically.

When the circuit breaker opens, contact arm 10 carries moving contact member 32 to the right, away from the position represented in FIG. 7. Relaxed pressure against head 68 and rod 66 allows spring 78 to push pin 72 and block 64 to the right, thereby biasing the toggle to buckle. As this action occurs, the grip of contacts 34*b* on moving contact member 32 is relaxed, and jaws 34*a* lift contacts 34*b* away from member 32. Pivot pins 58 move in slot 72 toward the right. The slow guides pivot pins 58, and maintains contacts 34*b* in symmetry at opposite sides of member 32 as contacts 34*b* move away from each other and from moving contact member 32. During the contact-opening operation of the main contacts, movable arcing contacts 36 slide between stationary arcing contacts 38*b*. After separation of the main contacts is assured, the arcing contacts part. Current in the arcing contacts forms an arc, which travels up arcing horns 38*c*, and the arc then expands into the arc chute where it is quenched.

Despite the abrupt motions of the stationary contact parts that occur in the extremely short time between the initial contact of head 68 by movable contact member 32 and the completion of the closing motion of the movable contact member, intense stresses are avoided which might otherwise cause premature wear of the parts. This is explained in part by the interposition of spring 70 between head 68 and the knees of the toggles for each pair of contact jaws, and by the mechanical advantage of the toggle while becoming more erect in operating the jaws 34*a* to grip member 32, and by the limited moment of inertia of each jaw 34*a*. The circuit breaker as a whole has been found remarkably durable and it has also been found highly effective in preserving the low contact resistance of the main movable and stationary contacts of the circuit breaker. The contact mechanism has proved to be highly effective in withstanding the wide variety of arduous conditions that may be encountered.

The foregoing detailed description of the illustrative embodiment of the invention is susceptible of modification and varied application of its novel features. Consequently the invention should be construed broadly in accordance with its full spirit and scope.

What is claimed is:

1. An electrical circuit making and breaking device including stationary contact means, movable contact means including a main movable contact member, means for operating the movable contact means into and out of cooperation with the stationary contact means, said stationary contact means including a pair of main contact jaws having respective pivots bearing contact surfaces that are opposite each other but spaced apart, a toggle operable toward an erect condition as the movable contact member advances in the space between said contact surfaces for driving said contact jaws so that said contact surfaces grip and are slidably engaged by the main movable contact member, and means on said movable contact means for operating said toggle.

2. An electrical circuit making and breaking device as in claim 1, wherein said means operating said toggle includes resilient means interposed between the toggle and the movable contact means.

3. An electrical circuit making and breaking device as in claim 1, wherein said means operating said toggle includes resilient means biasing the toggle toward a buckled condition.

4. An electrical circuit making and breaking device as in claim 1, wherein said means operating said toggle includes resilient means interposed between the toggle and the movable contact means, and resilient means biasing the toggle toward a buckled condition.

5. An electrical circuit making and breaking device as in claim 1, wherein said means operating said toggle includes a rod slidably extending through the knee of the toggle and arranged to be moved along its length by engagement of an end of the rod by said movable contact member, a compression spring interposed between the knee of the toggle and said end of the rod of resiliently biasing the toggle toward an erect condition as the movable contact member completes its closing stroke, and a compression spring biasing the toggle toward a buckled condition for opening the main contact jaws when the main movable contact member is retracted.

6. An electrical circuit making and breaking device including stationary contact means, movable contact means including a main movable contact member, means for operating the movable contact means into and out of cooperation with the stationary contact means, said stationary contact means including a pair of main contact jaws pivoted between first and second opposite ends thereof, main contacts on the first ends of said jaws, respectively, having contact surfaces that are opposite each other but spaced apart, and means operable by said movable contact means as the movable contact member enters the space between said contact surfaces for driving said second ends of the contact jaws farther from each other, thereby forcing the contact surfaces of the jaws to grip slidably the main movable contact member, said driving means including a toggle operable from a relatively collapsed condition when the contacts are open, toward an erect condition when the contacts are closed.

7. An electrical device as in claim 6, wherein said operable means includes an actuator engageable by said movable contact member as it enters the space between said contact surfaces.

* * * * *